US007610863B1

(12) United States Patent
Smith-Huebner

(10) Patent No.: US 7,610,863 B1
(45) Date of Patent: Nov. 3, 2009

(54) MOBILE MASSAGE TABLE

(76) Inventor: La Juana Smith-Huebner, 450 W. 152nd St., Apt. 43, New York, NY (US) 10031

( * ) Notice: Subject to any disclaimer, the term of this patent is extended or adjusted under 35 U.S.C. 154(b) by 0 days.

(21) Appl. No.: 12/163,232

(22) Filed: Jun. 27, 2008

(51) Int. Cl.
*A47B 3/00* (2006.01)

(52) U.S. Cl. ..... 108/36; 108/50.14; 108/38; 5/620

(58) Field of Classification Search ..... 108/65, 108/67, 50.14, 38, 34, 35, 36; 5/600, 620, 5/630, 431
See application file for complete search history.

(56) References Cited

U.S. PATENT DOCUMENTS 745,115 A * 11/1903 Petersen ..... 108/65
1,184,660 A * 5/1916 Rhine ..... 606/245
2,579,783 A * 12/1951 Branto ..... 5/617
2,699,976 A * 1/1955 Ranney ..... 108/67
3,031,084 A * 4/1962 Mugler ..... 108/16
3,207,093 A * 9/1965 Block ..... 108/16
4,020,771 A * 5/1977 Hasenour ..... 108/86
4,103,170 A * 7/1978 Spradlin ..... 378/179
4,693,187 A * 9/1987 Bisbing ..... 108/69
4,833,998 A 5/1989 Everett et al.
4,856,497 A * 8/1989 Westphal ..... 606/242
5,009,170 A 4/1991 Spehar
5,711,229 A * 1/1998 Piretti ..... 108/67
5,974,979 A 11/1999 Grady et al.
6,436,126 B1 * 8/2002 McAfee ..... 606/245
6,615,431 B2 * 9/2003 Lin ..... 5/620
6,705,234 B1 3/2004 Miller et al.

* cited by examiner

*Primary Examiner*—José V Chen
(74) *Attorney, Agent, or Firm*—Dale J. Ream

(57) ABSTRACT

A mobile massage table includes four platforms, each having opposed short and long sides. Three hinges are coupled to the platforms such that the platforms are movable between a stacked configuration and a planar/use configuration. Two hinges couple respective long sides of two panels together and one hinge couples respective short sides of two other panels together for movement of the respective panels to the stacked configuration. A leg is pivotally coupled to respective platforms and selectively movable between perpendicular configurations at the use configuration and parallel configurations at the stacked configuration. One or more center legs may also be coupled to the platforms to support the panels at the use configuration, the center legs being selectively movable between perpendicular and parallel configurations. The mobile massage table includes a cart having opposed rails configured to receive the platforms thereon in the stacked configuration, the cart including opposed wheels.

8 Claims, 7 Drawing Sheets

MOBILE MASSAGE TABLE

BACKGROUND OF THE INVENTION

This invention relates generally to massage therapy tools and, more particularly, to a mobile massage table that is foldable to one-quarter its expanded size for easy transport and storage.

Massage therapists' primary tools are their hands. However, the table for their patients to lie on during a massage session is also of vital importance. Some therapists make themselves available to travel to different locations to conduct massage therapy, such as to satellite offices or even to make house calls. Others simply desire to break down their massage tables for transport around an office or for storage. This is especially convenient when an office is being shared by massage therapists as well as other types of physicians or therapists.

Various devices have been proposed in the art for making tables, even massage tables, more portable and movable. Although assumably effective for their intended purposes, the existing massage tables either do not collapse conveniently or sufficiently or are not easily movable once collapsed.

Therefore, it would be desirable to have a mobile massage table that may be transformed from a use configuration and a transport configuration that is one-quarter the size of the use configuration. Further, it would be desirable to have a mobile massage table having a construction that is light weight and easy to manipulate and transport while still being sturdy and robust in the transport configuration. In addition, it would be desirable to have a mobile massage table that includes a specially configured cart for transporting and storing the collapsed massage table.

SUMMARY OF THE INVENTION

Therefore, a mobile massage table according to the present invention includes first, second, third, and fourth distinct platforms each having top and bottom sides, opposed short sides, and opposed long sides. A hinge rotatably couples a respective first platform long side to a respective fourth platform long side to selectively rotate the fourth platform bottom side toward the first platform bottom side. A hinge rotatably couples a respective second platform long side to a respective third platform long side to selectively rotate the third platform bottom side toward the second platform bottom side. A hinge rotatably couples a respective first platform short side to a respective second platform short side to selectively rotate the second platform top side toward the first platform top side.

A first leg is rotatably coupled to the first platform for selective movement between a use configuration in which the first leg extends generally perpendicular to the first platform and a transport configuration in which the first leg extends toward the second platform generally parallel to the first platform. A second leg is rotatably coupled to the second platform for selective movement between a use configuration in which the second leg extends generally perpendicular to the second platform and a transport configuration in which the second leg extends toward the first platform generally parallel to the second platform. A third leg is rotatably coupled to the third platform for selective movement between a use configuration in which the third leg extends generally perpendicular to the third platform and a transport configuration in which the third leg extends toward the fourth platform generally parallel to the third platform. A fourth leg is rotatably coupled to the fourth platform for selective movement between a use configuration in which the fourth leg extends generally perpendicular to the fourth platform and a transport configuration in which the fourth leg extends toward the third platform generally parallel to the fourth platform.

A first center leg is rotatably coupled to one of the first and second platforms for selective movement between a use configuration in which the first center leg extends generally perpendicular to the first and second platforms and a transport configuration in which the first center leg extends generally parallel to the first and second platforms. A second center leg is rotatably coupled to one of the third and fourth platforms for selective movement between a use configuration in which the second center leg extends generally perpendicular to the third and fourth platforms and a transport configuration in which the second center leg extends generally parallel to the third and fourth platforms. The massage table includes a plurality of folding braces, a respective folding brace coupling each leg to a respective platform to selectively maintain each leg at a respective use configuration.

Therefore, a general object of this invention is to provide a mobile massage table that is movable between use and transport configurations.

Another object of this invention is to provide a mobile massage table, as aforesaid, that folds to one-quarter of its expanded size.

Still another object of this invention is to provide a mobile massage table, as aforesaid, that includes a cart configured to transport the table in its transport or stacked configuration.

Yet another object of this invention is to provide a mobile massage table, as aforesaid, that is lightweight yet robust and durable.

A further object of this invention is to provide a mobile massage table, as aforesaid, that is easily and quickly movable between use and transport configurations.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A mobile massage table will now be described in detail with reference to FIG. 1 through FIG. 6 of the accompanying drawings. More particularly, a mobile massage table 100 includes four distinct platforms 110 (i.e., first platform 110*a*, second platform 110*b*, third platform 110*c*, fourth platform 110*d*).

Figure 2:
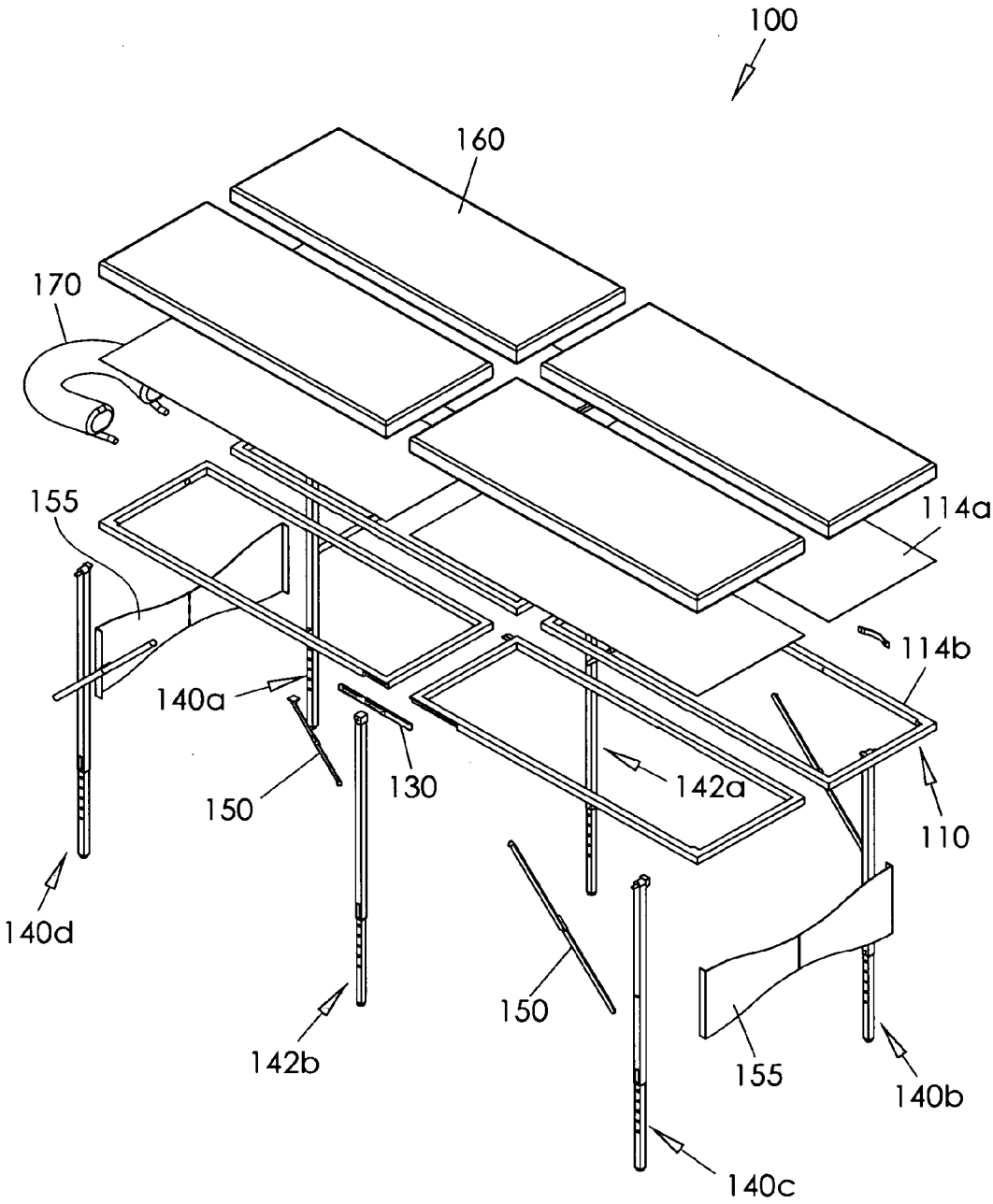
FIG. 2 is an exploded view of the mobile massage table as in FIG. 1.
Figure 3A:
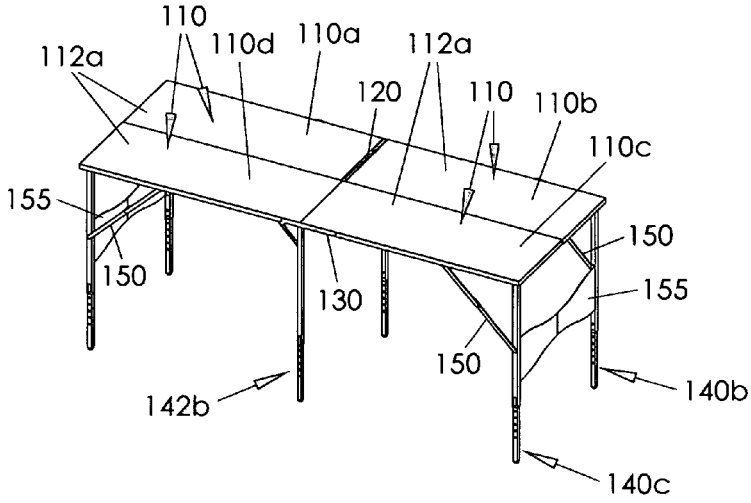
FIGS. 3*a* to 3*d* are perspective views showing movement of the massage table from a use configuration to a stacked configuration.
Figure 3B:
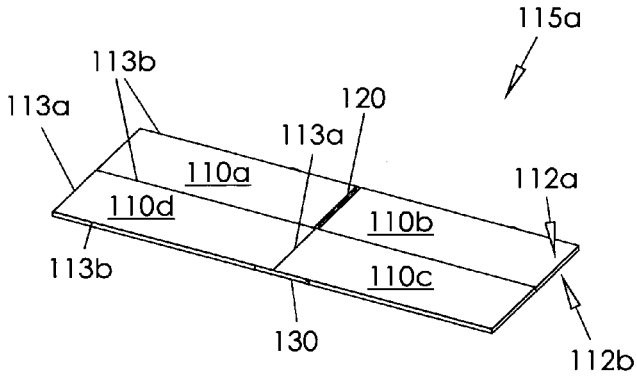

As shown in FIG. 3*b*, each platform 110 has top and bottom sides 112*a*, 112*b*, opposed short sides 113*a*, and opposed long sides 113*b*. Each platform 110 may include decking 114*a* coupled to a frame 114*b*, as shown in FIG. 2, or platforms 110 may alternately be of unitary construction.

Figure 3C:
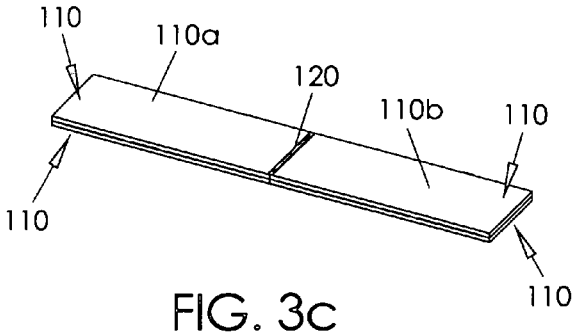
Figure 3D:
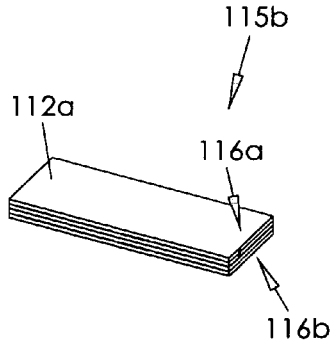

The four platforms 110 are movable between a generally planar configuration 115*a* (FIG. 3*b*) and a stacked configuration 115*b* (FIG. 3*d*). When at the generally planar configuration 115*a* (FIG. 3*b*), the top sides 112*a* are generally coplanar, and the four platforms 110 may define a generally rectangular perimeter. The stacked configuration 115*b* (FIG. 3*d*) has top and bottom sides 116*a*, 116*b*; one platform top side 112*a* may define the stacked configuration top side 116*a*, and another platform top side 112*a* may define the stacked configuration bottom side 116*b*. As such, all of the platform bottom sides 112*b* may be concealed when the platforms 110 are at the stacked configuration 115*b*.

Figure 6:
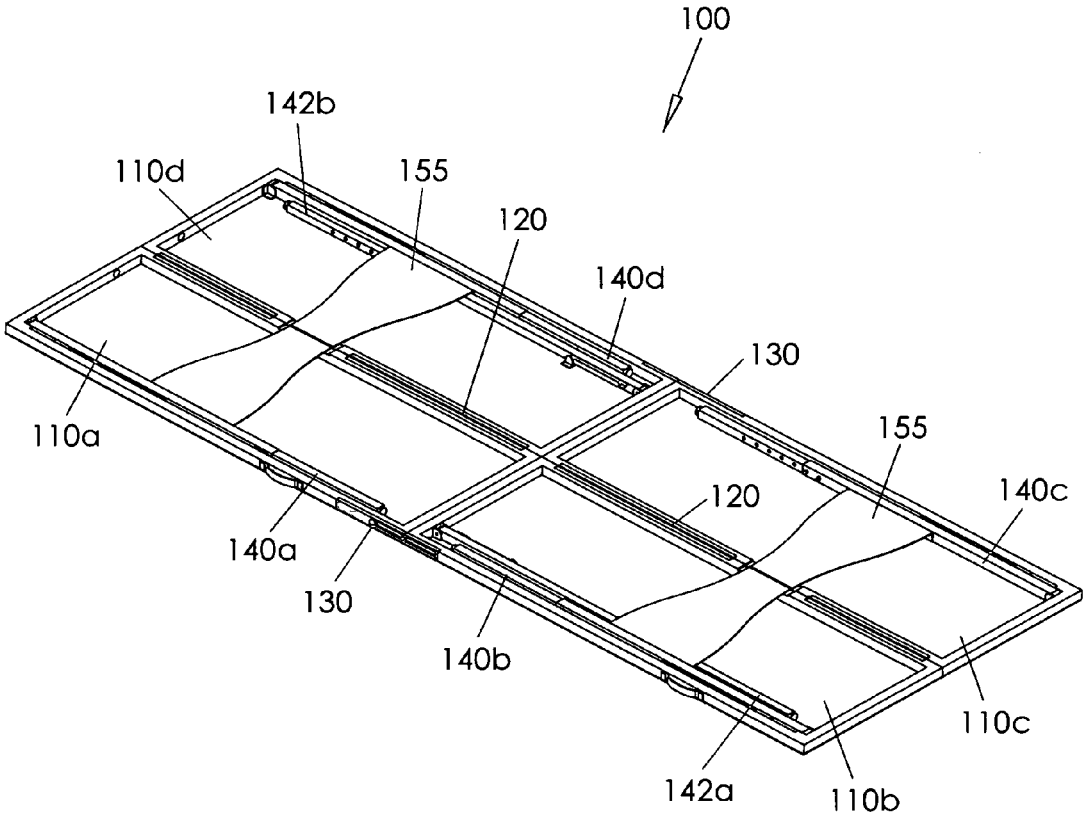
FIG. 6 is a bottom perspective view of the mobile massage table as in FIG. 3*b* such that the legs and braces are in retracted or storage configurations.
Figure 7:
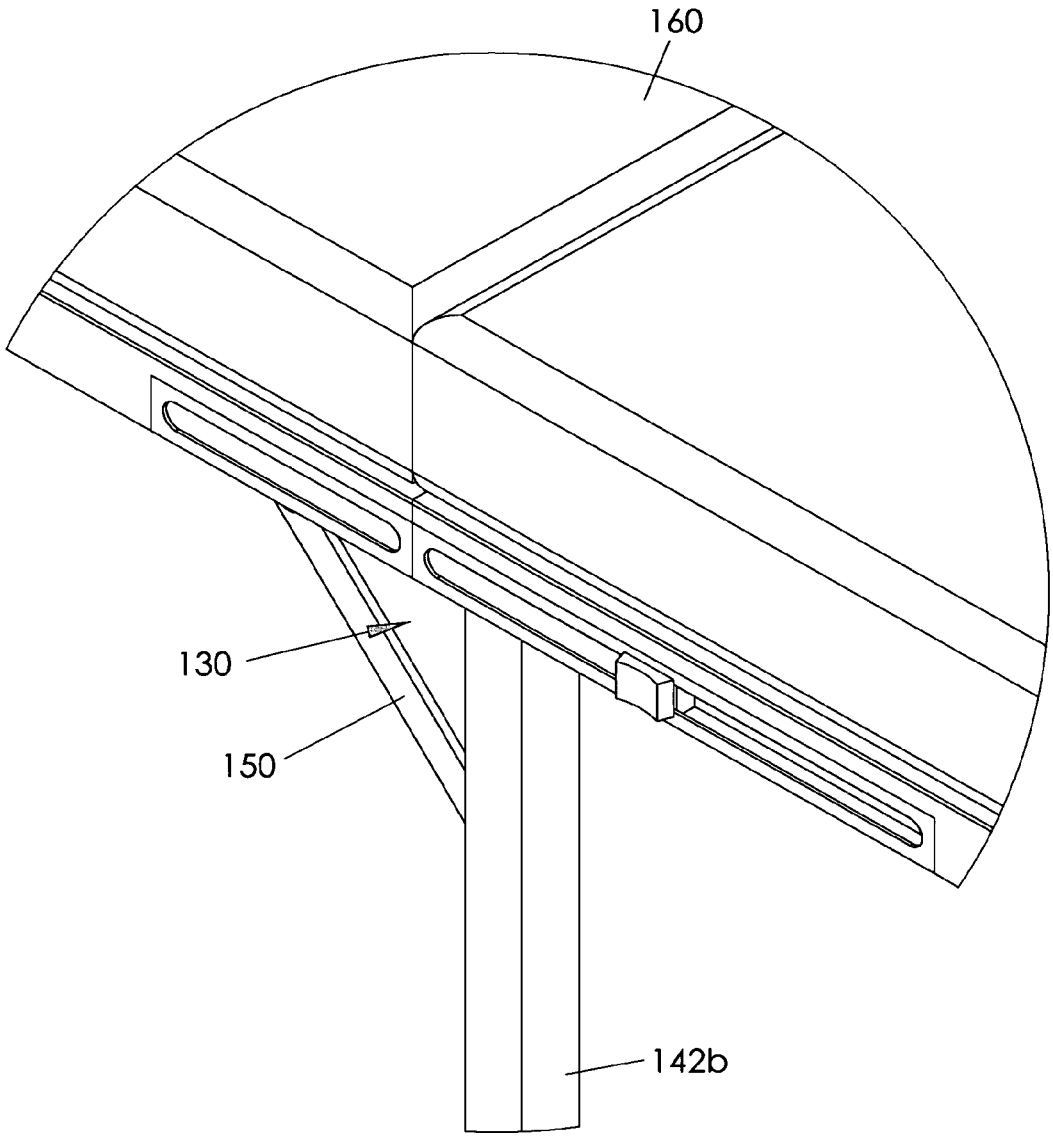
FIG. 7 is an isolated view on an enlarged scale taken from FIG. 1.

Three hinges 120 are coupled to the platforms 110 to allow the platforms 110 to move between the generally planar configuration 115*a* and the stacked configuration 115*b*. Two of the hinges 120 extend generally perpendicular to the remaining hinge 120. As shown in FIGS. 3*b* and 6, a first hinge 120 may rotatably couple a respective long side 113*b* of the first platform 110*a* to a respective long side 113*b* of the fourth platform 110*d* to selectively rotate the bottom side 112*b* of the fourth platform 110*d* toward the bottom side 112*b* of the first platform 110*a*; a second hinge 120 may rotatably couple a respective long side 114 of the second platform 110*b* to a respective long side 113*b* of the third platform 110*c* to selectively rotate the bottom side 112*b* of the third platform 110*c* toward the bottom side 112*b* of the second platform 110*b*; and a third hinge 120 may rotatably couple a respective short side 113*a* of the first platform 110*a* to a respective short side 113*a* of the second platform 110*b* to selective rotate the top side 112*a* of the second platform 110*b* toward the top side 112*a* of the first platform 110*a*.

Figure 1:
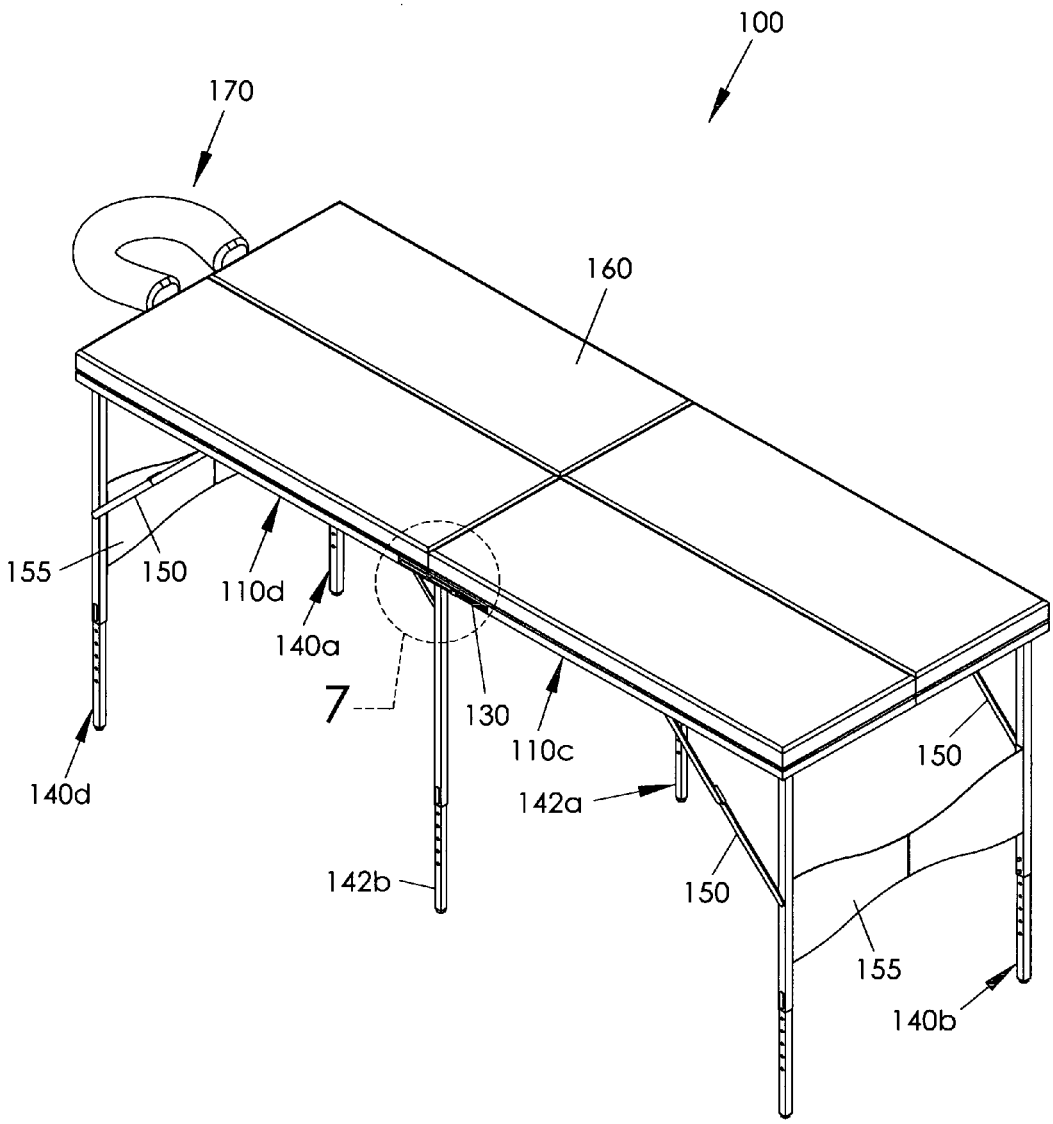
FIG. 1 is a perspective view of a mobile massage table according to a preferred embodiment of the present invention.

A lock (e.g., sliding lock 130 shown in FIG. 1) is movable between a first position in which the lock interacts with only one platform 110 and a second position in which the lock interacts with two platforms 110 to maintain those two platforms 110 at the generally planar configuration 115*a*. For example, the sliding lock 130 shown in FIG. 1 is movable between a first position in which the sliding lock 130 interacts with only one of the third platform 110*c* and the fourth platform 110*d* and a second position in which the sliding lock 130 interacts with both the third platform 110*c* and the fourth platform 110*d*; the upper side 112*a* of the third platform 110*c* is generally planar with the upper side 112*a* of the fourth platform 110*d* when the sliding lock 130 is at the second position. The lock may preferably interact with the two platforms 110 that are not directly coupled together by a hinge 120. It should be understood that additional locks may also be used.

Means for adjusting a height of the platforms 110 when the platforms 110 are at the generally planar configuration 115*a* are included. For example, at least one leg may be removably or rotatably coupled to one or more platform 110 to raise the platforms 110 above a ground surface. In one embodiment, a first leg 140*a* is rotatably coupled to the first platform for selective movement between a use configuration (FIG. 1) in which the first leg 140*a* extends generally perpendicular to the first platform 110*a* and a transport configuration (FIG. 6) in which the first leg 140*a* extends generally parallel to the first platform; a second leg 140*b* is rotatably coupled to the second platform 110*b* for selective movement between a use configuration (FIG. 1) in which the second leg 140*b* extends generally perpendicular to the second platform 110*b* and a transport configuration (FIG. 6) in which the second leg 140*b* extends generally parallel to the second platform 110*b*; a third leg 140*c* is rotatably coupled to the third platform 110*c* for selective movement between a use configuration (FIG. 1) in which the third leg 140*c* extends generally perpendicular to the third platform 110*c* and a transport configuration in which the third leg 140*c* extends generally parallel to the third platform 110*c*; and a fourth leg 140*d* is rotatably coupled to the fourth platform 110*d* for selective movement between a use configuration (FIG. 1) in which the fourth leg 140*d* extends generally perpendicular to the fourth platform 110*d* and a transport configuration (FIG. 6) in which the fourth leg 140*d* extends generally parallel to the fourth platform 110*d*. The legs may be adjustable height legs, as shown in FIG. 1.

The first leg 140*a* may extend toward the second platform 110*b* when at the transport configuration; the second leg 140*b* may extend toward the first platform when at the transport configuration; the third leg 140*c* may extend toward the fourth platform when at the transport configuration; and the fourth leg 140*d* may extend toward the third platform 110*c* when at the transport configuration. As shown in FIG. 6, when the legs are at the transport configurations, the first leg 140*a* may be inside the first platform 110*a*, the second leg 140*b* may be inside the second platform 110*b*, the third leg 140*c* may be inside the third platform 110*c*, and the fourth leg 140*d* may be inside the fourth platform 110*d*.

Center legs may also be included to support the platforms 110 above the ground surface. For example, in one embodiment, a first center leg 142*a* is coupled to either the first or second platform 110*a*, 110*b* for selective movement between a use configuration in which the first center leg 142*a* extends generally perpendicular to the first and second platforms 110*a*, 110*b* (FIG. 1) and a transport configuration in which the first center leg 142*a* extends generally parallel to the first and second platforms 110*a*, 110*b*; a second center leg 142*b* is coupled to either the third or fourth platform 110*c*, 110*d* for selective movement between a use configuration in which the second center leg 142*b* extends generally perpendicular to the third and fourth platforms 110*c*, 110*d* (FIG. 1) and a transport configuration in which the second center leg 142*b* extends generally parallel to the third and fourth platforms 110*c*, 110*d*.

A plurality of folding braces 150 (FIGS. 1 and 2) may be included so that a respective folding brace 150 couples each leg to a respective platform 110 to maintain the legs at the use configurations. One folding brace 155 may be coupled to the second leg 140*b* and the third leg 140*c* to selectively restrict the second leg 140*b* from moving relatively toward the third leg 140*c*, and another folding brace 155 may be coupled to the first leg 140*a* and the fourth leg 140*d* to selectively restrict the first leg 140*a* from moving relatively toward the fourth leg 140*d*.

As shown in FIG. 1, at least one cushion 160 may be configured for simultaneous placement atop the top sides 112*a* of the four platforms 110 when the platforms 110 are at the generally planar configuration 115*a*. The cushions 160 may be removably or permanently attached to the platforms 110.

A headrest 170 may be removably or rotatably coupled to at least one platform 110 to extend beyond the generally rectangular perimeter when the platforms 110 are at the generally planar configuration 115*a*. For example, as shown in FIG. 1, the headrest 170 may be removably coupled to the first platform 110*a* and/or the fourth platform 110*d* to extend beyond a respective first platform short side 113*a* and a respective fourth platform short side 113*a*.

Figure 4A:
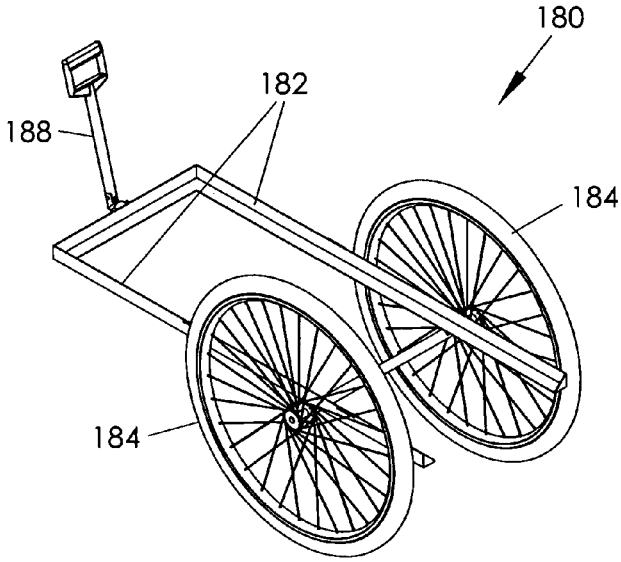
FIG. 4*a* is a perspective view of a cart according to a preferred embodiment of the present invention.
Figure 4B:
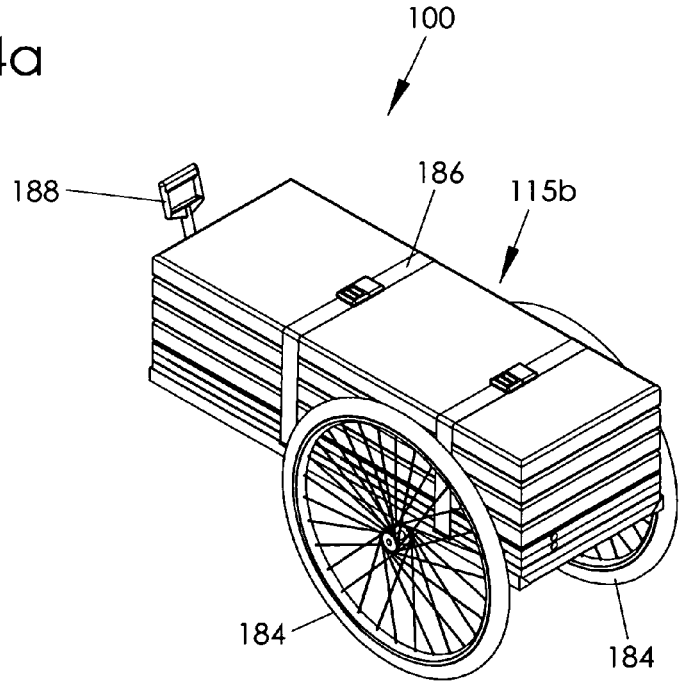
FIG. 4*b* is another perspective view of the cart with the massage table in a stacked configuration loaded thereon.
Figure 5A:
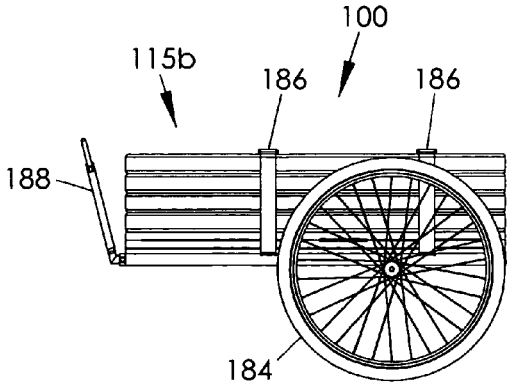
FIG. 5*a* is a side view of the cart and stacked massage table as in FIG. 4*b* with a handle at one configuration.
Figure 5B:
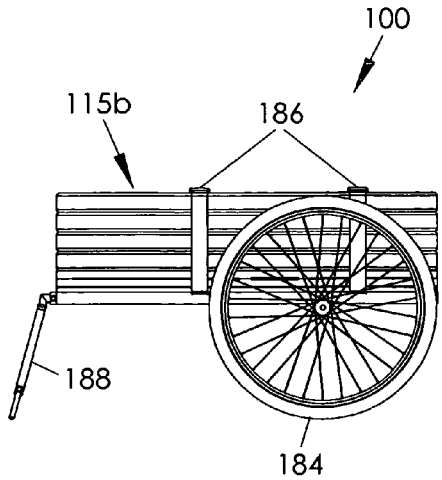
FIG. 5*b* is a side view of the cart and stacked massage table as in FIG. 5*a* with the handle at another configuration.
Figure 5C:
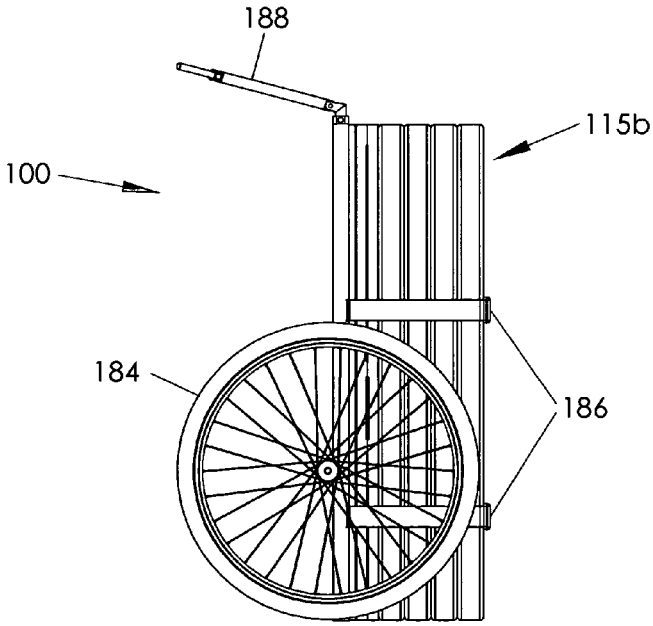
FIG. 5*c* is a side view of the cart and stacked massage table inverted to a storage configuration.

Each platform 110 has a width between respective long sides 113*b*, and the width for each platform 110 is generally equal to the widths of the other platforms 110. As shown in FIGS. 4*a* through 5*c*, a cart 180 may be included that has opposed rails 182 and at least one wheel 184 operatively coupled to each opposed rail 182. The opposed rails 182 are separated by a distance at least as long as the platform width to receive the platforms 110 thereon, and at least one strap 186 may be included to selectively couple the platforms 110 to the opposed rails 182 (FIG. 4*b*). A handle 188 may be operatively coupled to the opposed rails 182, and the handle 188 may at least be pivotable about a generally horizontal axis, as can be seen by comparing FIGS. 5*a* and 5*b*.

In use, the platforms 110 may start at the stacked configuration 115*b* (FIG. 3*d*), and the cart 180 may be used to transport the platforms 110 as set forth above and shown in FIGS. 4*b* through 5*c*. Once the platforms 110 are separated from the cart 180 (FIG. 3*d*), the single hinge 120 that is generally perpendicular to the two remaining hinges 120 may be used to rotate two of the platforms 110 (e.g., first platform 110*a* and second platform 110*b*) away from one another, as shown in FIG. 3*c*. The two generally parallel hinges 120 may then be used to rotate two other platforms 110 (e.g., third platform 110*c* and fourth platform 110*d*) to the generally planar configuration 115*a* (FIG. 3*b*), and the lock (e.g., sliding lock 130) may be moved to interact with two platforms 110 (e.g., third and fourth platforms 110*c*, 110*d*) to maintain the platforms 110 at the generally planar configuration 115*a* (FIG. 3*b*). The legs 140*a*, 140*b*, 140*c*, 140*d*, 142*a*, 142*b* may be moved to the use configurations, and the braces 150, 155 may be used to maintain the legs at the use configurations. The headrest 170 and cushion(s) 160 may be added to the platforms 110 as set forth above.

To transport the mobile massage table 100, the platforms may be moved to the stacked configuration 115*b* (FIG. 3*d*) by removing the headrest 170 and cushion(s) 160, moving the legs to the transport configurations, moving the lock (e.g., sliding lock 130) from interacting with two platforms 110, using the generally parallel hinges 120 to rotate two platforms 110 (e.g., fourth platform 110*d* and third platform 110*c*) toward two other platforms 110 (e.g., first platform 110*a* and second platform 110*b*), and using the perpendicular hinge 120 to rotate two platforms (e.g., first platform 110*a* and second platform 110*b*) toward one another. The platforms 110 may then be coupled to the cart 180 (e.g., by the strap(s) 186) and easily moved.

It is understood that while certain forms of this invention have been illustrated and described, it is not limited thereto except insofar as such limitations are included in the following claims and allowable functional equivalents thereof.

The invention claimed is:

1. A mobile massage table, comprising:

first, second, third, and fourth distinct platforms each having top and bottom sides, opposed short sides, and opposed long sides;

a hinge rotatably coupling a respective first platform long side to a respective fourth platform long side to selectively rotate said fourth platform bottom side toward said first platform bottom side;

a hinge rotatably coupling a respective second platform long side to a respective third platform long side to selectively rotate said third platform bottom side toward said second platform bottom side;

a hinge rotatably coupling a respective first platform short side to a respective second platform short side to selectively rotate said second platform top side toward said first platform top side;

a first leg rotatably coupled to said first platform for selective movement between a use configuration in which said first leg extends generally perpendicular to said first platform and a transport configuration in which said first leg extends toward said second platform generally parallel to said first platform;

a second leg rotatably coupled to said second platform for selective movement between a use configuration in which said second leg extends generally perpendicular to said second platform and a transport configuration in which said second leg extends toward said first platform generally parallel to said second platform;

a third leg rotatably coupled to said third platform for selective movement between a use configuration in which said third leg extends generally perpendicular to said third platform and a transport configuration in which said third leg extends toward said fourth platform generally parallel to said third platform;

a fourth leg rotatably coupled to said fourth platform for selective movement between a use configuration in which said fourth leg extends generally perpendicular to said fourth platform and a transport configuration in which said fourth leg extends toward said third platform generally parallel to said fourth platform;

a first center leg rotatably coupled to one of said first and second platforms for selective movement between a use configuration in which said first center leg extends generally perpendicular to said first and second platforms and a transport configuration in which said first center leg extends generally parallel to said first and second platforms;

a second center leg rotatably coupled to one of said third and fourth platforms for selective movement between a use configuration in which said second center leg extends generally perpendicular to said third and fourth platforms and a transport configuration in which said second center leg extends generally parallel to said third and fourth platforms;

a plurality of folding braces, a respective folding brace coupling each leg to a respective platform to selectively maintain each leg at a respective use configuration; and a sliding lock positioned on said third platform and movable between a first position in which said sliding lock interacts with only one of said third platform and said fourth platform and a second position in which said sliding lock interacts with both of said third platform and said fourth platform, said third and fourth platforms being maintained generally parallel to one another and said third platform top side being generally planar with said fourth platform top side when said sliding lock is at said second position.

2. The mobile massage table of claim 1, wherein:

said first leg is inside said first platform when at said transport configuration;

said second leg is inside said second platform when at said transport configuration;

said third leg is inside said third platform when at said transport configuration; and said fourth leg is inside said fourth platform when at said transport configuration.

3. The mobile massage table of claim 1, further comprising:

a folding brace coupled to said second leg and said third leg to selectively restrict said second leg from moving relatively toward said third leg; and a folding brace coupled to said first leg and said fourth leg to selectively restrict said first leg from moving relatively toward said fourth leg.

4. The mobile massage table of claim 3, further comprising:

at least one cushion configured for placement atop said first platform top side, said second platform top side, said third platform top side, and said fourth platform top side, simultaneously; and a headrest removably coupled to at least one of said first platform and said fourth platform and extending beyond a respective first platform short side and a respective fourth platform short side when coupled thereto.

5. The mobile massage table of claim 4, wherein each said leg is an adjustable height leg.

6. The mobile massage table of claim 5, wherein each said platform includes decking coupled to a frame.

7. The mobile massage table of claim 6, wherein each said platform has a width between respective long sides, each said width being generally equal, said mobile massage table further comprising a cart having:

opposed rails separated by a distance at least as long as said width to receive said platforms thereon;

at least one strap for selectively coupling said platforms to said opposed rails;

at least one wheel coupled to each said opposed rail; and a handle operatively coupled to said opposed rails, said handle being pivotable about a generally horizontal axis.

8. The mobile massage table of claim 1, wherein each said platform has a width between respective long sides, each said width being generally equal, said mobile massage table further comprising a cart having:

opposed rails separated by a distance at least as long as said width to receive said platforms thereon;

at least one strap for selectively coupling said platforms to said opposed rails;

at least one wheel coupled to each said opposed rail; and a handle operatively coupled to said opposed rails, said handle being pivotable about a generally horizontal axis.

* * * * *